US006065297A

United States Patent [19]

Tischer et al.

[11] Patent Number: 6,065,297

[45] Date of Patent: May 23, 2000

[54] LIQUID CHILLER WITH ENHANCED MOTOR COOLING AND LUBRICATION

[75] Inventors: James C. Tischer, La Crescent, Minn.; Dennis R. Dorman, La Crosse, Wis.

[73] Assignee: American Standard Inc., Piscataway, N.J.

[21] Appl. No.: 09/169,841

[22] Filed: Oct. 9, 1998

[51] Int. Cl.[7] ..... F25B 43/02; F25B 31/00

[52] U.S. Cl. ..... 62/84; 62/471; 62/505

[58] Field of Search ..... 62/505, 471, 84, 62/DIG. 2

[56] References Cited

U.S. PATENT DOCUMENTS

| | | | |
|---|---|---|---|
| 1,899,378 | 2/1933 | Zouck et al. | 62/471 X |
| 1,951,915 | 3/1934 | Kagi | 62/115 |
| 2,246,845 | 6/1941 | Durden | 62/115 |
| 2,768,511 | 10/1956 | Moody | 62/117.8 |
| 2,975,613 | 3/1961 | Heidorn | 62/192 |
| 3,112,618 | 12/1963 | Weller . | |
| 3,149,478 | 9/1964 | Anserson et al. . | |
| 3,263,435 | 8/1966 | Endress et al. | 62/84 |
| 3,299,655 | 1/1967 | Rayner et al. | 62/193 |
| 3,304,741 | 2/1967 | Weller | 62/471 |
| 3,331,216 | 7/1967 | Rayner . | |
| 3,389,569 | 6/1968 | Endress . | |
| 3,416,330 | 12/1968 | Weller et al. | 62/505 |
| 3,820,350 | 6/1974 | Brandin et al. | 62/193 |
| 3,838,581 | 10/1974 | Endress | 62/468 |
| 4,061,187 | 12/1977 | Rajasekaran et al. . | |
| 4,084,406 | 4/1978 | Brenneman | 62/211 |
| 4,404,812 | 9/1983 | Zinsmeyer . | |
| 4,669,279 | 6/1987 | Maeda et al. | 62/505 |
| 4,671,081 | 6/1987 | Fujiwara et al. | 62/469 |
| 4,720,981 | 1/1988 | Helt et al. . | |
| 4,938,664 | 7/1990 | Zinsmeyer | 417/83 |
| 5,086,621 | 2/1992 | Starner et al. | 62/84 |
| 5,165,248 | 11/1992 | Sishtla | 62/84 |
| 5,182,919 | 2/1993 | Fujiwara | 62/193 |
| 5,396,784 | 3/1995 | Huenniger | 62/471 |
| 5,481,887 | 1/1996 | Terasaki | 62/471 |
| 5,606,872 | 3/1997 | Terasaki | 62/471 |
| 5,675,978 | 10/1997 | Hamm et al. . | |
| 5,724,821 | 3/1998 | Lord et al. | 62/84 |

FOREIGN PATENT DOCUMENTS

| | | | |
|---|---|---|---|
| 406235555 | 8/1994 | Japan | 62/DIG. 2 |
| 1 380 758 | 1/1975 | United Kingdom . | |
| WO 94/23252 | 10/1994 | WIPO . | |
| WO 96/41106 | 12/1996 | WIPO . | |

*Primary Examiner*—William Wayner
*Attorney, Agent, or Firm*—William J. Beres; William O'Driscoll; Peter D. Ferguson

[57] ABSTRACT

An enhanced motor cooling and lubrication system for a liquid chiller includes a liquid refrigerant cooled compressor drive motor, wherein the refrigerant used to cool the drive motor is returned to the chiller's condenser, and apparatus to better facilitate the return of oil carried to the compressor entrained in the suction gas flow stream back to the chiller's oil supply tank.

72 Claims, 8 Drawing Sheets

LIQUID CHILLER WITH ENHANCED MOTOR COOLING AND LUBRICATION

BACKGROUND OF THE INVENTION

This patent application is related to a commonly assigned U.S. patent application filed on even date herewith entitled "Oil-Free Liquid Chiller" as well as commonly assigned and allowed U.S. patent application Ser. No. 08/965,495, now U.S. Pat. No. 5,848,538 entitled "Oil and Refrigerant Pump for Centrifugal Chiller" and any divisional applications that may derive therefrom.

The present invention relates to liquid chillers. More particularly, the present invention relates to refrigeration machines of the centrifugal type the purpose of which is to cool a liquid, most typically water, for use in building comfort conditioning or industrial process applications. With still more particularity, the present invention relates to a centrifugal refrigeration chiller having significantly enhanced motor cooling and lubrication arrangements.

Refrigeration chillers are machines that employ a refrigerant fluid to temperature condition a liquid, such as water, most often for purposes of using such liquid as a cooling medium in an industrial process or to comfort condition the air in a building. Refrigeration chillers of larger capacity are typically driven by compressors of the centrifugal type resulting in the denomination of such machines as "centrifugal chillers".

Centrifugal compressors are compressors which, by the high speed rotation of one or more impellers in a volute housing, act on a refrigerant gas to compress it. The impeller or impellers of a centrifugal compressor, the shaft on which they are mounted and, in the case of so-called direct drive compressors, the rotor of the compressor drive motor, weigh hundreds if not thousands of pounds. The relatively high speed rotation of such physically large and heavy chiller components at several thousand RPM presents unique and challenging bearing lubrication issues. Likewise, the heat developed by the motor which drives such components is significant and the temperatures associated with motor operation can be relatively very high, particularly under certain operating and load conditions. As a result, proactive cooling of the compressor drive motor is required.

Centrifugal chiller lubrication and motor cooling arrangements are generally well developed. However, there is ever increasing pressure to increase the overall efficiency of such chillers which are typically among the largest energy users in a building or industrial process. At the same time, restrictions on the kinds of refrigerants that can be used in such chillers have been established due to environmental concerns.

The characteristics of newer, more environmentally friendly refrigerants are such as to have the effect of potentially reducing the effectiveness and reliability of chiller motor cooling systems. This is because such newer refrigerants are lower pressure refrigerants and the use thereof results in significantly decreased pressure differentials across the chiller systems in which they are employed, particularly when certain operating conditions exist. Such pressure differentials have historically been used to cause or assist in the movement and delivery of refrigerant to a chiller's compressor drive motor for motor cooling purposes.

For example, in current chillers manufactured by the assignee of the present invention (assignee being the largest manufacturer of such chillers in the world) which employ newer, low pressure refrigerants and which rely on chiller pressure differentials to move refrigerant, a limit is imposed on so-called low head operation to ensure that refrigerant is both delivered to and returned from the motor location whenever the chiller is operating. The low head limit is a differential pressure, as measured between the high pressure and low pressure sides of the chiller system, which is minimally sufficient to ensure the supply and return of refrigerant to a chiller's compressor drive motor when the chiller is operating. In certain present chillers, the low head limit is approximately 5 psi.

While the low head limit is typically not reached, it can be reached under certain relatively infrequently occurring operating conditions where newer, low pressure refrigerants are employed. The existence of such conditions, even if only infrequent and/or transitory, can result in periods of chiller shutdown to avoid motor overheating during which the chiller will not produce the chilled liquid which is necessary to the purpose for which the chiller is employed. Where a chiller is used to comfort condition air in a large factory or a commercial, government or school building or the like or where a chiller is used in an industrial process that relies upon a continuous supply of water which is chilled to a specified temperature for production of an end-product, such as computer chips, chemicals or the like, chiller downtime is to be avoided if at all possible.

Because current systems operate based on the existence of the pressure differential between the source location for refrigerant, the location of its use (the compressor drive motor) and/or the location to which it is returned from after such use, the location of use must be at a pressure lower than the pressure at the source location. In the case of prior and current centrifugal chillers, refrigerant used for motor cooling is typically driven through an orifice from the relatively high pressure condenser of the chiller to the housing in which the compressor drive motor is housed where the refrigerant is brought into contact with the motor in order to cool it. The orifice acts as a pressure boundary between the relatively high pressure condenser and (1) the lower pressure motor housing and (2) the location to which the refrigerant is returned from the motor housing.

Because a significant portion of the liquid refrigerant driven from the condenser to the motor will flash to gas in its passage through the orifice and prior to having any motor cooling effect, the refrigerant delivered to the motor for motor cooling purposes in such systems is much less effective for that purpose than would be the case if it were delivered to the motor entirely in the liquid state. As such, while current motor cooling arrangements are, in fact, effective, the actual cooling effect of the refrigerant driven to a drive motor and overall chiller efficiency is significantly degraded as a result of that refrigerant's gas content.

As a result of demands for increased chiller efficiency and for chiller motor cooling systems that do not make use of or rely upon pressure differentials that may or may not exist in the chiller under certain operating conditions, particularly with the advent and use of newer refrigerants, the need exists to provide for a motor cooling system that operates across the entire operating range of the chiller and which acts to minimize the chiller efficiency loss that results from the motor cooling process. In conjunction with such change to chiller motor cooling arrangements and because (1) a certain amount of refrigerant will make its way into the chiller's lubrication system and (2) a certain amount of lubricant will make its way into the chiller's refrigeration circuit, the need and opportunity also exists to improve chiller lubrication systems so as to make them more reliable, to enhance the return of oil which finds its way into the chiller's refrigeration circuit back to the chiller's lubrication system and to maintain such oil therein.

SUMMARY OF THE INVENTION

It is an object of the present invention to cool the compressor drive motor in a centrifugal chiller using liquid refrigerant.

It is another object of the present invention to cool the motor of the compressor in a centrifugal chiller in a manner which eliminates the parasitic effect of compressor motor cooling on chiller efficiency.

It is a still further object of the present invention to significantly reduce motor operating temperatures in a centrifugal chiller by minimizing and/or eliminating the flashing of liquid refrigerant used for motor cooling purposes prior to its delivery to the motor for such purpose.

It is still another object of the present invention to avoid the use of and dependency on differential pressures existing within a refrigeration chiller to drive liquid refrigerant to the drive motor of the chiller's compressor for motor cooling purposes while minimizing the adverse effects of the motor cooling arrangement on chiller efficiency.

It is another object of the present invention to provide an enhanced chiller lubrication system which better facilitates the return of oil that makes its way into the refrigeration circuit of a chiller back to the chiller's oil supply tank.

It is also an object of the present invention to deliver lubricant to surfaces within a refrigeration chiller that require lubrication when the chiller is in operation and to simultaneously deliver liquid refrigerant to the compressor drive motor of such a chiller for motor cooling purposes under all chiller operating conditions, preferably by use of a single pumping mechanism and with greater motor cooling effect than prior systems.

It is still another object of the present invention to provide a lubrication system in a refrigeration chiller that minimizes the loss of lubricant from the chiller oil supply tank to the chiller's refrigeration circuit as a result of the pressure drop and oil foaming that occurs in the oil supply tank when the chiller starts up.

It is a still further object of the present invention to eliminate the need for apparatus, such as an eductor, to return oil which accumulates in the suction area of the compressor of a centrifugal chiller to a location where it can be re-used for lubrication purposes.

These and other objects of the present invention, which will become apparent by reference to the following Description of the Preferred Embodiment and attached drawing figures, are accomplished, in the preferred embodiment, in a centrifugal refrigeration chiller in which (i) saturated liquid refrigerant is pumped to the chiller's compressor drive motor from the system condenser for motor cooling purposes in a manner which enables the return of such refrigerant to the condenser and thereby enhances the motor cooling effect of the refrigerant as well as overall chiller efficiency and (ii) oil is pumped, preferably by the same apparatus and under all chiller operating conditions, from an oil supply tank to surfaces in the chiller which require lubrication and is reliably returned thereto, even after migration of a portion of such oil into the chiller's refrigeration loop.

DESCRIPTION OF THE DRAWING FIGURES

Drawing FIGS. 1 and 2 are end and side views of the refrigeration chiller of the present invention.

DESCRIPTION OF THE PREFERRED EMBODIMENT

Figure 2:
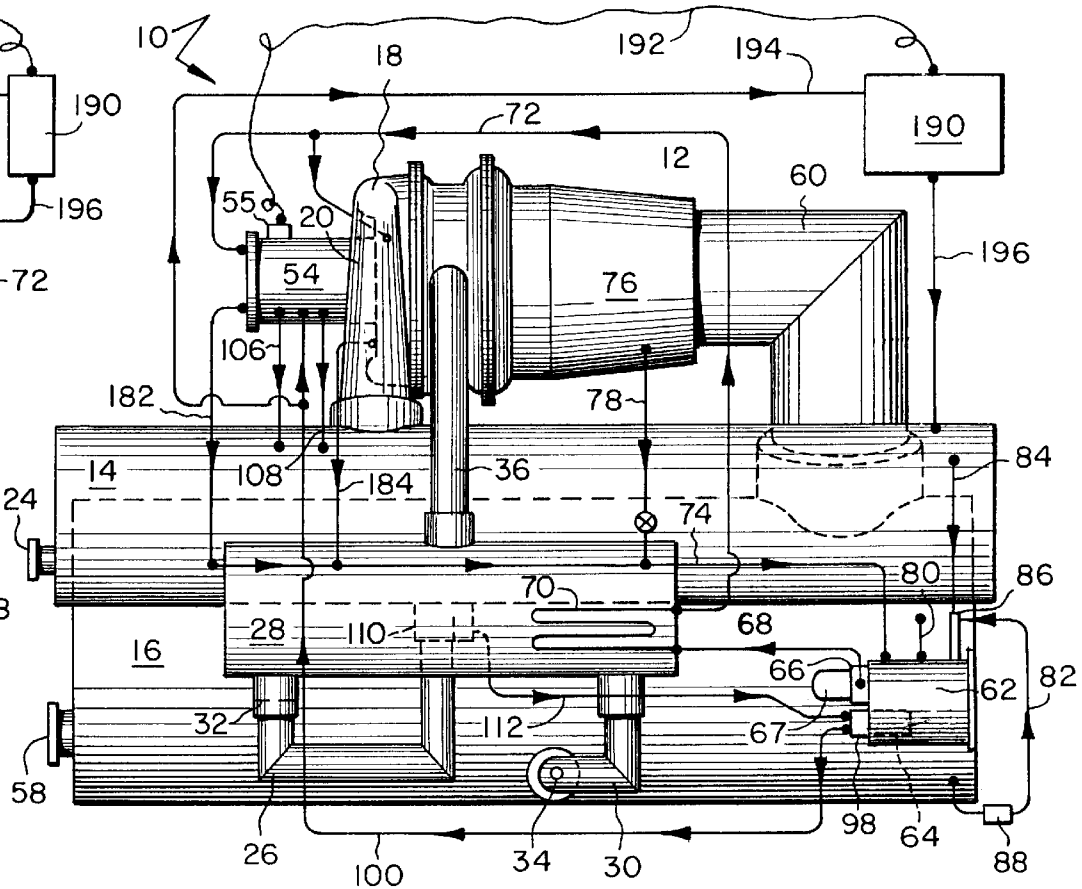
Figure 1:
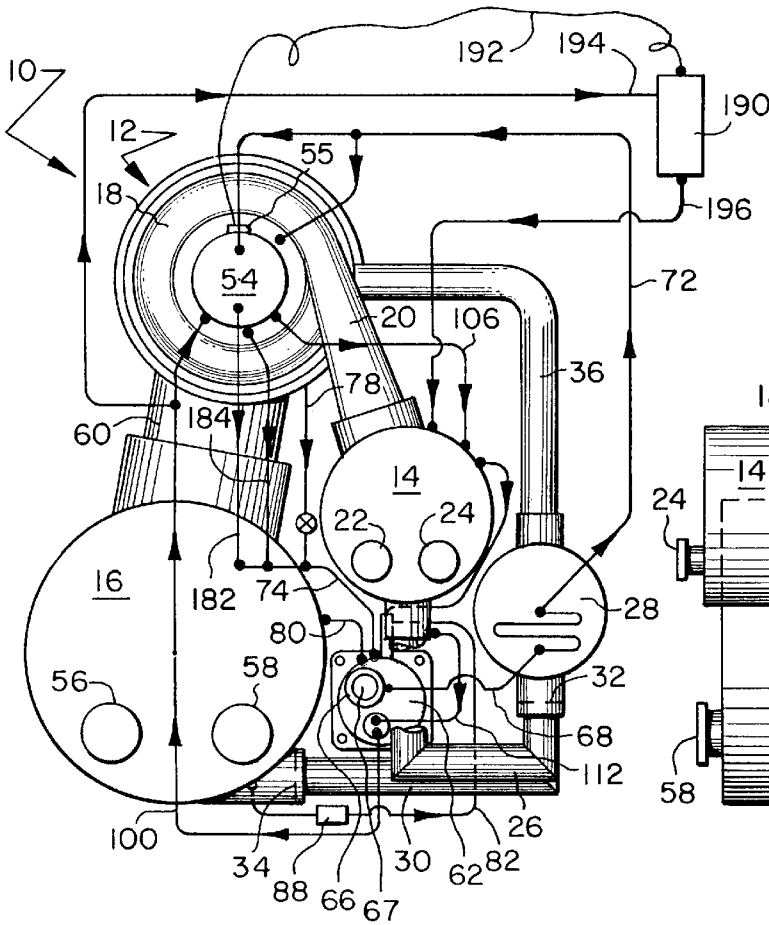

Referring first to Drawing FIGS. 1 and 2, centrifugal chiller 10 is comprised of a compressor portion 12, a condenser 14 and an evaporator 16. Refrigerant gas is compressed within compressor portion 12 and is directed out of discharge volute 18 into piping 20 which connects compressor portion 12 of chiller 10 to condenser 14.

The high pressure, relatively hot compressed refrigerant gas delivered to condenser 14 will typically be cooled by a liquid which enters the condenser through inlet 22 and exits the condenser through outlet 24. This liquid, which is typically city water or water that passes to, through and back from a cooling tower, exits the condenser after having been warmed in a heat exchange relationship with the refrigerant that is delivered from the compressor to the condenser.

The heat exchange process occurring within condenser 14 causes the relatively hot, compressed refrigerant gas delivered thereinto to cool, condense and pool in the bottom of the condenser. The condensed refrigerant then flows out of condenser 14 through discharge piping 26 and is directed, in the preferred embodiment, to an economizer 28. The refrigerant is next delivered, primarily in liquid form, from economizer 28 into evaporator 16. It is to be noted that although economizer 28, which constitutes efficiency enhancing apparatus, is employed in the context of the preferred embodiment of the present invention, use of an economizer is optional.

Where an economizer is employed, the liquid refrigerant flowing from condenser 14 will flow through a first metering device 32 prior to entering the economizer and through a second metering device 34, downstream thereof, prior to entering the evaporator. Metering devices 32 and 34 will most typically be fixed orifices. A portion of the liquid refrigerant flowing through these orifices will vaporize in passing through them due to the pressure drop associated therewith.

The refrigerant gas generated in the economizer as a result of the passage of liquid refrigerant through metering device 32 into economizer 28 will still be at a relatively elevated pressure. Such gas is communicated out of economizer 28 through piping 36 and is directed to a location within compressor portion 12 of chiller 10 where it mixes with the relatively lower pressure gas undergoing compression therein. This mixing process increases the pressure of the gas undergoing compression apart from the increase in pressure occasioned by the motor-driven rotation of the compressor's impellers. As such, less work is required of the compressor and its motor to compress gas and overall chiller efficiency is increased.

Figure 3:
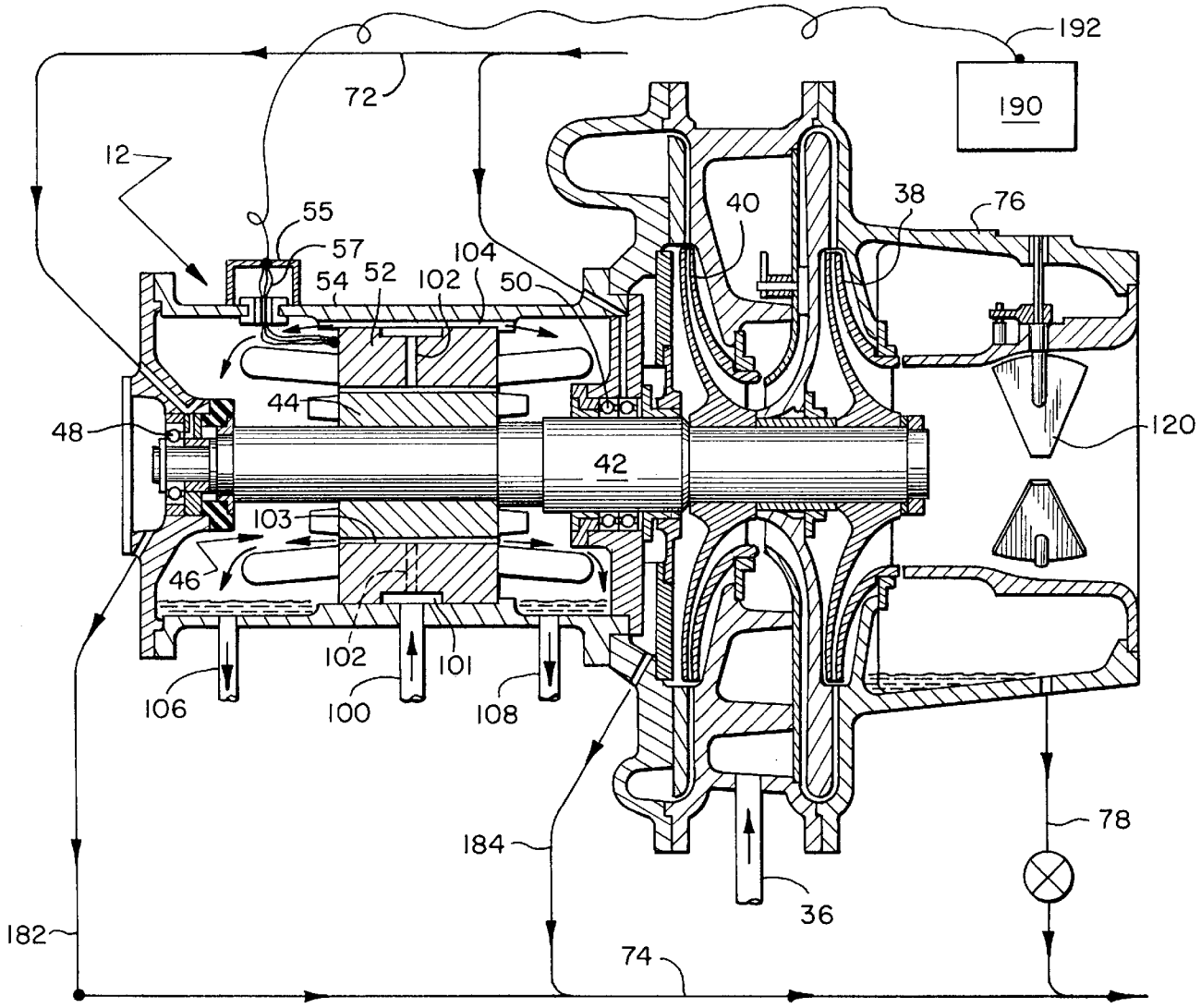
FIG. 3 is a cross-section of the compressor portion of the chiller of the present invention.

Referring additionally now to FIG. 3, compressor portion 12, in the preferred embodiment, is a two-stage device wherein first impeller 38 and second impeller 40 are mounted for rotation on shaft 42. Each of impellers 38 and 40 act on the gas traveling to and through them to increase the pressure of such gas in a multi-stage process. Shaft 42 on which impellers 38 and 40 and, in the preferred embodiment, the rotor 44 of compressor drive motor 46 are mounted is rotatably supported in bearing 48 and bearing package 50 while the stator 52 of motor 46 is fixedly mounted in motor housing 54 which is also referred to as the "motor barrel". Bearing 48 and bearing package 50 require the delivery of oil thereto for bearing lubrication purposes while, in the preferred embodiment, motor 46 requires the delivery of liquid refrigerant thereto for motor cooling purposes when chiller 10 is in operation.

Referring back now to Drawing FIGS. 1 and 2 and to the flow of refrigerant out of economizer 28, liquid refrigerant is directed out of economizer 28 through second metering device 34. The passage of liquid refrigerant through metering device 34 causes a further pressure drop in the liquid refrigerant that passes therethrough, the flashing of another portion of that refrigerant to gas as well as the further cooling of that refrigerant due to such flashing. The now relatively cool, low pressure liquid refrigerant is delivered to evaporator 16 where it undergoes heat exchange with and cools the relatively warmer medium, such as water, that enters the evaporator through inlet 56 and exits thereoutof through outlet 58. That now-cooled medium is, in turn, delivered into heat exchange contact with the heat load which it is the purpose of the chiller to cool.

In the process of cooling the medium which flows through the evaporator and being heated thereby, the liquid refrigerant delivered to the evaporator vaporizes and is directed through piping 60, as a low pressure suction gas, back to compressor portion 12 of the chiller. The refrigerant gas is thereagain compressed in an ongoing and repetitive process whenever the chiller is in operation.

Figure 4:
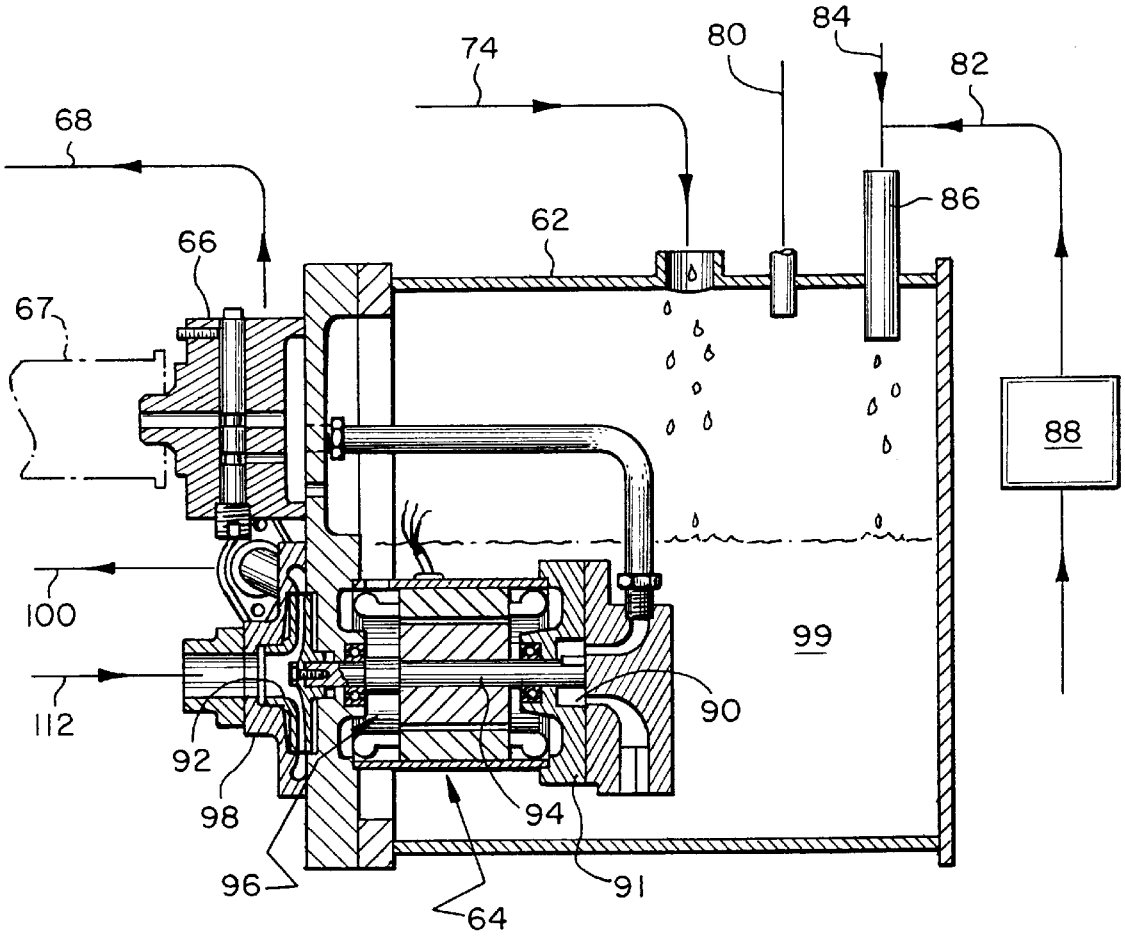
FIGS. 4 is a cross-sectional view of the oil supply tank and pump arrangement of the chiller of the present invention.

Still referring to Drawing FIGS. 1 and 2 and additionally now to FIG. 4, other features of the lubrication and motor cooling arrangement of the chiller of the present invention and their interrelationship will further be described. In that regard, an oil supply tank 62 is mounted on chiller 10, the location of oil supply tank 62 being physically below condenser 14. Pump apparatus 64, which is preferably a pump of the type taught and claimed in a cant's copending U.S. patent application Ser. No. 08/965,495, now U.S. Pat. No. 5,848,538 assigned to the assignee of the present invention, is employed to pump both oil for lubrication purposes and liquid refrigerant for motor cooling purposes within and through the chiller in a manner which will further be described. Although pump 64 in the present invention will preferably be of the dual purpose type taught and claimed in the aforesaid co-pending patent application, it is to be understood that separate pumps or pumping mechanisms, one capable of pumping oil and the other capable of pumping liquid refrigerant, could be employed and fall within the scope of the present invention.

With respect to the pumping of liquid refrigerant by pump 64 from condenser 14 to the compressor drive motor, such pumping benefits from the disposition of the oil supply tank and pump 64 physically below condenser 14. Disposition of pump 64 below condenser 14 causes a head to be maintained in line 112 by which liquid refrigerant is supplied from condenser 14 to pump 64 for motor cooling purposes. Since the refrigerant supplied from condenser 14 is a saturated liquid, it is prone to flashing to gas as a result of even a small pressure drop in it. Such pressure drops inherently tend to occur where saturated liquid refrigerant is attempted to be pumped. The flashing of saturated liquid refrigerant to gas, should it occur when attempts are made to pump it, causes pump cavitation. Ultimately, the continued pumping of such saturated liquid can fail to occur as the flashing/cavitation process feeds upon itself where the pump or associated systems are not properly designed.

Pump apparatus 64, as will further be described, is of a unique design and together with its disposition at a location physically below the source of refrigerant from which it pumps, is capable of pumping saturated liquid refrigerant to a location of use essentially without causing the flashing of the pumped saturated liquid refrigerant and, therefore, without pump cavitation. It is applicant's belief that pump 64 is the first pump employed in conjunction with a liquid chiller that is capable of reliably pumping saturated liquid refrigerant under all chiller operating conditions. The advantages of employing pump 64, rather than differential pressure, to deliver liquid refrigerant to the chiller's drive motor for motor cooling purposes will be discussed below.

Pump apparatus 64 also pumps oil from supply tank 62 to through a manifold 66 which is preferably of the type taught and claimed in U.S. Pat. No. 5,675,978, likewise assigned to the assignee of the present invention. Such oil travels through line 68 into economizer 28 where it enters an oil cooling heat exchanger 70 disposed therein. Heat exchanger 70 is immersed in the liquid refrigerant that exists within the economizer when the chiller is in operation. Disposition of heat exchanger 70 in economizer 28 eliminates the need for the discrete external oil cooling heat exchanger found on many of today's chillers and the bathing of heat exchanger 70 in liquid refrigerant results in enhanced oil cooling as compared to many such external heat exchangers.

In its passage through heat exchanger 70, lubricating oil is cooled prior to being delivered through line 72 to compressor portion 12 of the chiller and, referring again and additionally now to FIG. 3, to the bearings 48 and 50 in which shaft 42 is mounted for rotation. Subsequent to its use to lubricate the bearings in compressor portion 12 of the chiller, oil drains from compressor portion 12, by virtue of its disposition at a height above the oil supply tank, and is returned thereto, in the preferred embodiment, through piping 74.

It is to be noted and as is common in centrifugal chillers, a portion of the oil used for lubrication purposes will make its way through and across compressor bearings and seals into the refrigerant loop of the chiller where it will be carried through the chiller system with the system refrigerant. While this portion of the chiller's oil supply is relatively very small, over a period of time migration of a dangerously large portion of the chiller's oil supply to the refrigeration loop can occur if not otherwise accounted for by the return of such lubricant to the chiller's lubrication system.

Because it is a cold, low pressure location in the chiller system, lubricant that migrates into a chiller's refrigeration loop tends to be carried to and settle in the lower portion of the system evaporator. A portion of the lubricant carried into the evaporator is, however, carried out of the evaporator in the suction gas that flows thereoutof through piping 60 into the suction housing 76 of compressor portion 12 of the chiller. At least some of the lubricant carried into suction housing 76 comes to be disentrained and settles therein. In the preferred embodiment of the present invention, provision is made for the return of oil which collects in suction housing 76 through a line 78 which connects housing 76 to oil supply tank 62. That oil return process and apparatus is further described below.

Other portions/features of the lubrication system of chiller 10 of the present invention include the provision of a vent line 80 by which the interior of oil supply tank 62 is vented to evaporator 16 and is thereby maintained at the same relatively low pressure that is found in the evaporator when the chiller is in operation. The effect of vent line 80 on the operation of the lubrication system of chiller 10 is described below as is the operation of an alternative embodiment of the present invention by which the use of vent line 80 is dispensed with.

Further with respect to the chiller lubrication system and as noted above, not only will a small amount of lubricant come to collect in the suction housing of the compressor portion of a centrifugal chiller, lubricant will also tend to collect in the lower portion of a chiller's evaporator. As such, provision must be made to return the oil rich liquid which collects in the lower portion of a chiller's evaporator to the oil supply tank to ensure that the chiller's supply of oil is not depleted over time by its migration to and retention in that location.

With respect thereto, the chiller of the present invention, in its preferred embodiment, includes an eductor arrangement for oil reclaim purposes. The eductor arrangement includes piping 82, which opens into the lower region of evaporator 16 where an oil-rich mixture of oil and liquid refrigerant will often be found to exist when the chiller is in operation, as well as a line 84 which opens into a portion of condenser 14 where high pressure gas exists when the chiller is in operation. Lines 82 and 84 are joined to form an eductor 86 which makes use of a bleed of high pressure gas from condenser 14 to draw oil rich liquid out of the bottom of low pressure evaporator 16 for deposit into the chiller's oil supply tank. A filter 88 can be disposed in line 82 so as to trap particulate or debris that would otherwise be drawn out of the bottom of evaporator 16 by the eductor arrangement. The evaporator, being a relatively low pressure location as was earlier noted, typically comes to be a repository for particulate and debris within a chiller system. Arrangements other than or in addition to the use filter 88 by which to prevent the delivery of particulate or debris to the oil supply tank will be described below.

Referring still to FIGS. 1–4 but now to refrigerant flow within the refrigerant loop/circuit of chiller 10, the primary refrigeration circuit components consist of compressor portion 12, condenser 14 and evaporator 16 which are connected for serial flow. In the preferred embodiment, economizer 28 is disposed in the refrigerant flow path between the condenser and evaporator.

Historically, while liquid refrigerant has, in fact, been used to cool the motor which drives the compressor in many centrifugal chiller designs, the delivery of liquid refrigerant to cool such motors has typically been predicated on the use of a pressure differential existing within the chiller system to drive liquid refrigerant from a relatively high pressure source location, such as the chiller condenser, through an orifice and to the relatively lower pressure compressor motor barrel for motor cooling purposes. Such refrigerant is, most often, subsequently returned to the chiller's refrigeration circuit by such differential pressure at a location where the pressure in the refrigeration circuit is likewise low.

The delivery of liquid refrigerant to compressor drive motors for motor cooling purposes in current and prior centrifugal chillers, to the extent a pressure differential is relied upon to cause the delivery of liquid refrigerant to the compressor drive motor, typically results in the flashing of a significant portion of such liquid refrigerant to gas in the delivery process. This causes the refrigerant delivered to a motor in the motor cooling process to be a two-phase, gas-liquid fluid the heat transfer capability of which is far lower than would be the case if only single-phase liquid refrigerant were delivered into heat exchange contact with the motor for the reason that gas is a much poorer heat transfer medium than liquid. It is believed, in fact, that as much as 10% by weight of the liquid refrigerant delivered to a motor in current and prior motor cooling systems flashes to gas prior to having any effect on motor cooling. That translates to a far higher percentage of gas, by volume, of the refrigerant delivered to the motor for cooling purposes.

As has been mentioned above, new, more environmentally friendly refrigerants are such that an adequate pressure differential cannot be relied upon to exist to drive liquid refrigerant to the drive motor of the chiller's compressor for motor cooling purposes under certain extreme and relatively infrequently occurring chiller operating conditions. That disability potentially imposes a requirement, under some such circumstances, to shut the chiller down when such operating conditions come to exist in order to fully protect the components of the compressor portion of the chiller from damage due to overheating and/or lubricant starvation.

Referring primarily now to FIG. 4, pump apparatus 64 in the present invention has two impellers, 90 and 92, which are driven on a common shaft 94 and eliminates the need to potentially shut down chiller 10 when such operating conditions come to exist. Shaft 94 is driven by an electric motor 96. Motor 96 and the bearings in which shaft 94 are rotatably supported are both cooled and lubricated by the oil in which they are immersed interior of the oil supply tank.

Pump impeller 92 is disposed within impeller housing 98 which is exterior of the oil supply tank and is isolated from the lubricant 99 stored therein by a seal (not shown) through which shaft 94 passes. Together, impeller 92 and housing 98 constitute a first pumping mechanism while impeller 90 and the housing 91 in which it is disposed constitute a second pumping mechanism. Impeller housing 98 is in flow communication with both condenser 14, from which impeller 92 draws liquid refrigerant through line 112, and refrigerant line 100 through which pump 64 delivers liquid refrigerant to compressor drive motor housing 54.

Referring primarily now to both FIGS. 3 and 4, an annular passage 101 circumscribes motor stator 52 and is in flow communication with refrigerant line 100. The liquid refrigerant pumped into and flowing through annular passage 101 acts to cool the exterior of the motor stator and is metered through a plurality of passages 102 through stator 52 into rotor-stator gap 103 where it acts to further cool stator 52 as well as rotor 44. Such refrigerant flows out of rotor-stator gap 103 and also out of annular passage 101 into cut 104 along the top of motor stator 52 which is open at its longitudinal ends. This refrigerant acts to cool the ends of both the motor rotor and stator by flowing onto them. Such refrigerant then flows to the bottom of motor housing 54 from where it drains back to condenser 14 through lines 106 and 108.

Because motor housing 54 is maintained at condenser pressure due to the sourcing of motor cooling refrigerant from that location and its return thereto and because there is very little or essentially no pressure drop in the liquid refrigerant delivered to motor 46 by pump 64, the refrigerant delivered to the compressor drive motor by pump 64 is not prone to flashing prior to having a cooling effect on the motor and is delivered thereto essentially entirely in the liquid state. This significantly increases the effectiveness of the compressor motor cooling arrangement of the present invention for the reason that the single phase liquid refrigerant delivered to the motor has a far superior ability to exchange heat with the motor than does the two-phase, liquid-gas refrigerant fluid which is typically delivered to a compressor drive motor for cooling purposes in prior and current chiller systems that rely on a pressure differential to effect refrigerant delivery to and return from the compressor drive motor. True liquid cooling of motor 46 is thus achieved by the present invention.

While the motor barrel of the present invention will, on the whole, run warmer because the refrigerant used to cool the motor is sourced from and returned to the condenser (a relatively higher temperature location in the context of the chiller system), the actual cooling effect of the refrigerant delivered to the motor within the barrel for motor cooling purposes, because it is in liquid form, is tremendously greater, particularly with respect to motor hot spots. In that regard, peak temperatures in certain motor locations have been found to be lower by 100° F. and more when the chiller of the present invention is operating under rigorous conditions as compared to motor temperatures in those same locations in current and prior chiller systems which rely on a pressure differential for the delivery of motor cooling refrigerant when operating under the same rigorous conditions.

The significantly lower motor operating temperatures achieved by the present invention enhance overall chiller system efficiency, prolong motor life and increase chiller reliability. These results are, once again, obtained as a result of the pumping of essentially gas-free liquid refrigerant to and into contact with the drive motor. Such pumping is, in turn, predicated on the sourcing of liquid refrigerant for motor cooling purposes from the system condenser, disposition of the condenser at a predetermined height above the refrigerant pump (which provides a head from which to pump) and return of refrigerant used for drive motor cooling back to the condenser from which it was pumped. While a portion of the liquid refrigerant delivered to the motor flashes to gas in the process of cooling motor 46 (but generally not prior to effecting such heat transfer), the portion of such refrigerant that remains in the liquid state in the motor barrel drains, as earlier mentioned, out of housing 54 and returns, along with portions of the now-flashed refrigerant gas, to condenser 14 through lines 106 and 108.

Other very significant advantages of circulating refrigerant from the condenser, through the motor barrel and back to the condenser for motor cooling purposes and maintaining the motor barrel at condenser pressure will now be described. In that regard, by the use of the motor cooling arrangement of the present invention, chiller 10 is made more efficient as a result of its ability to reject heat generated by the drive motor to a location outside of the chiller itself. This, in turn, eliminates the parasitic effect of motor cooling on chiller efficiency. More specifically, by returning the liquid refrigerant used for motor cooling from the compressor motor housing to the system condenser, the motor heat carried therein is transferred to the medium that flows to, through and out of the condenser. That medium and the heat contained therein is, therefore, carried out of the chiller.

In prior and in certain current systems, the refrigerant used to cool the compressor drive motor has typically been driven therefrom by a pressure differential to the system evaporator, a relatively low pressure location. By carrying motor heat into the lower pressure system evaporator, the main purpose of which is to cool the medium flowing through it for use in cooling the external heat load the chiller is employed to cool, motor cooling in such chiller systems has had a parasitic effect on the overall efficiency of such systems. In the chiller of the present invention, motor heat is carried out of the chiller system, via the condenser, in a manner which eliminates what would otherwise be the parasitic effect of motor cooling on chiller system efficiency experienced in many prior and current chiller systems.

A still further and significant benefit of the motor cooling arrangement of the present invention which results from the fact that the refrigerant used for motor cooling is both sourced from and returned to the condenser is that neither the compressor motor barrel nor housing 55, through which access to the power leads 57 of motor 46 is gained from exterior of the chiller, will be so cool as to permit the development of condensation within housing 55 at the location of the motor power leads. In systems where a pressure differential is relied upon to deliver refrigerant to the compressor drive motor and such motor cooling refrigerant is returned to the system evaporator, communication of the motor barrel with the relatively cold evaporator can cause the motor barrel itself to be relatively cool even though the motor disposed in the motor barrel is relatively ineffectively cooled and will, in many motor locations, run far in excess of 100° F. warmer than motors cooled in accordance with the present invention. Because the motor barrel in prior systems can run relatively cool under certain temperature and humidity conditions, even while the motor mounted therein runs relatively very hot in certain motor locations, the interior of motor lead housing 55, which is on the outside of the motor barrel can, under some conditions, be at a low enough temperature to permit condensation to form therein. Condensation in such locations is to be avoided if possible.

In the motor cooling arrangement of the present invention, motor housing 54 will, on the whole, run warmer than current and prior pressure differential-based motor cooling systems where motor cooling refrigerant is returned to the relatively cold evaporator by virtue of the fact that the refrigerant delivered to the motor in the present invention is both sourced from and returned to the relatively much warmer condenser. Because the refrigerant delivered to the drive motor in the present invention is essentially all in the liquid state, it will, however, have significantly greater cooling effect with respect to the motor itself. The motor barrel of the present invention will, therefore, be maintained at a temperature sufficiently high to ensure that under no operating or external environmental conditions will condensation form within motor lead housing 55 all while the motor itself is far better cooled, particularly at typically hotter motor locations, and is cooled in a manner which enhances chiller system efficiency as compared to the motor cooling arrangements of earlier chiller systems.

Figure 5:
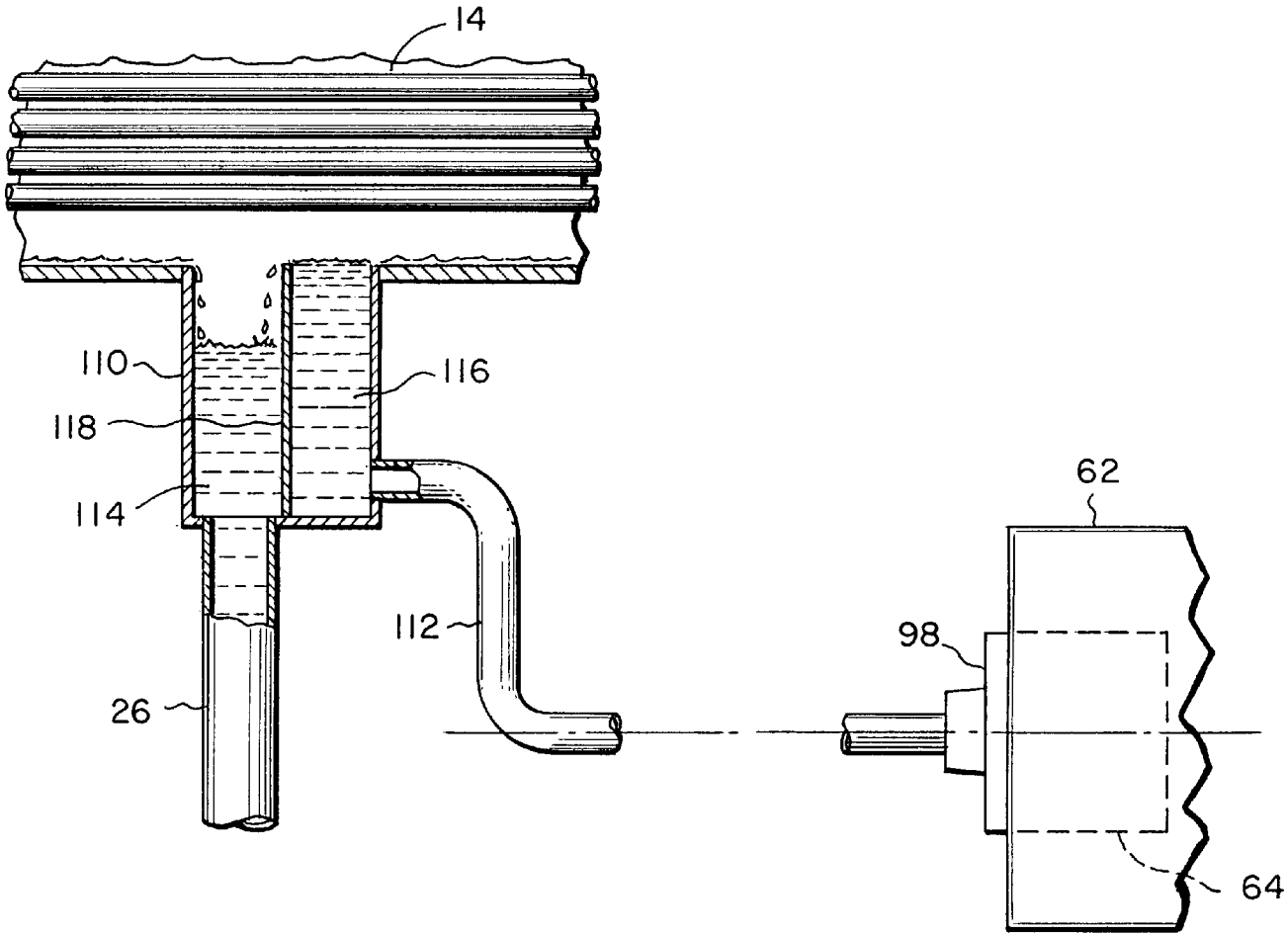
FIG. 5 illustrates the weir portion of the condenser of the chiller of the present invention and its arrangement for delivering liquid refrigerant from the condenser to the pump by which liquid refrigerant is delivered to the chiller's drive motor for motor cooling purposes.

Still referring to FIGS. 1–4 but additionally now to FIG. 5 and with regard to the supply of liquid refrigerant from which refrigerant pumping impeller 92 of pump 64 pumps, such refrigerant is sourced from well 110 of condenser 14. Refrigerant impeller 92 pumps liquid refrigerant from that location, through line 112, to the compressor's drive motor, increasing the pressure of the pumped liquid refrigerant to a pressure which exceeds condenser pressure in the process. As will be apparent from FIG. 5, condenser well 110 is split into two sections 114 and 116 by a weir 118. With reference to the location of well 110 in the context of the length of condenser 14, as will be appreciated from FIG. 2, the larger lengthwise portion of condenser 14 is found to feed section 116 of well 110 while the shorter lengthwise section of the condenser feeds section 114 thereof.

Liquid refrigerant used for motor cooling purposes is pumped by pump 64 from condenser 14 out of section 116 of well 110. Because section 116 of well 110 is fed by a larger portion of the condenser and fills with liquid refrigerant condensed therein, it is preferentially fed and maintained full of liquid refrigerant in comparison to section 114. This preferential feeding of liquid refrigerant to pump 64 is for the purpose of ensuring that the compressor drive motor of the chiller always has access to liquid refrigerant for motor cooling purposes whenever the chiller is operating, even when the production of liquid refrigerant in condenser 14, such as under extremely low load conditions, is minimal. It is to be noted that in centrifugal chillers manufactured by applicant, the chiller can function under extremely low load conditions with the inlet guide vanes 120 illustrated in FIG. 3 fully closed. Such guide vanes are used to modulate the capacity of the chiller and under such circumstances the chiller's compressor operates to compress only the relatively small amount of refrigerant gas that leaks by the closed inlet guide vanes.

When guide vanes 120 are in their fully closed position, chiller 10 will produce only about 10% of the cooling capacity it is capable of providing and, as such, will more efficiently accommodate the cooling of a reduced heat load. Under such circumstances, production of liquid refrigerant in condenser 14 will be minimal but sufficient to ensure a supply of liquid refrigerant in section 116 of well 110 which, when full, overflows into section 114 thereof for use in the chiller's refrigeration loop.

Figure 7:
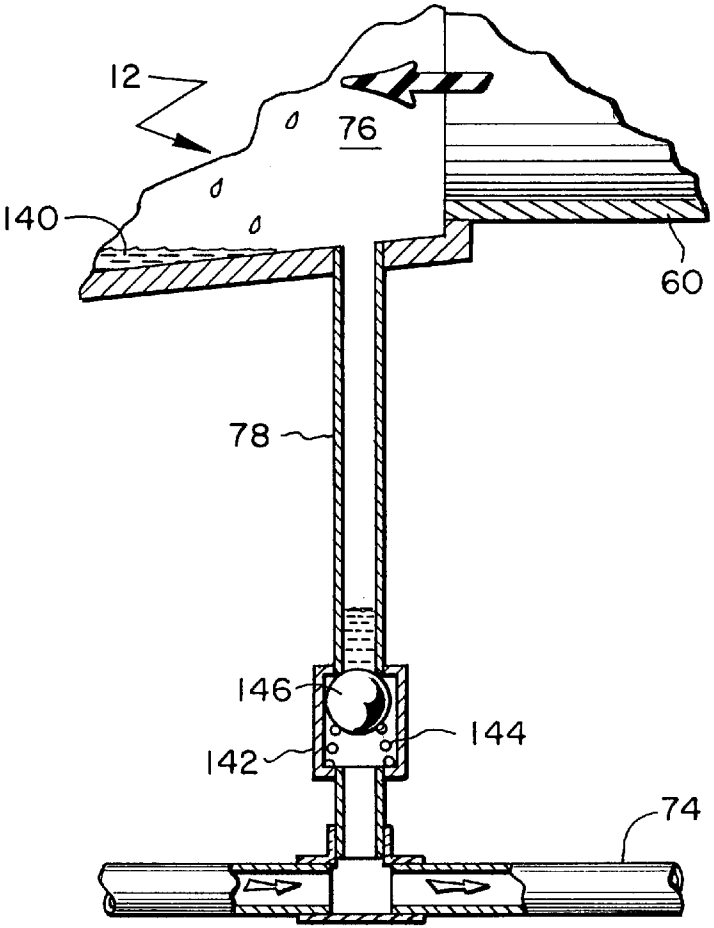
FIG. 6 and 7 illustrate the arrangement of the present invention by which lubricant is returned from the suction area of the chiller's compressor to the chiller's oil supply tank.
Figure 6:
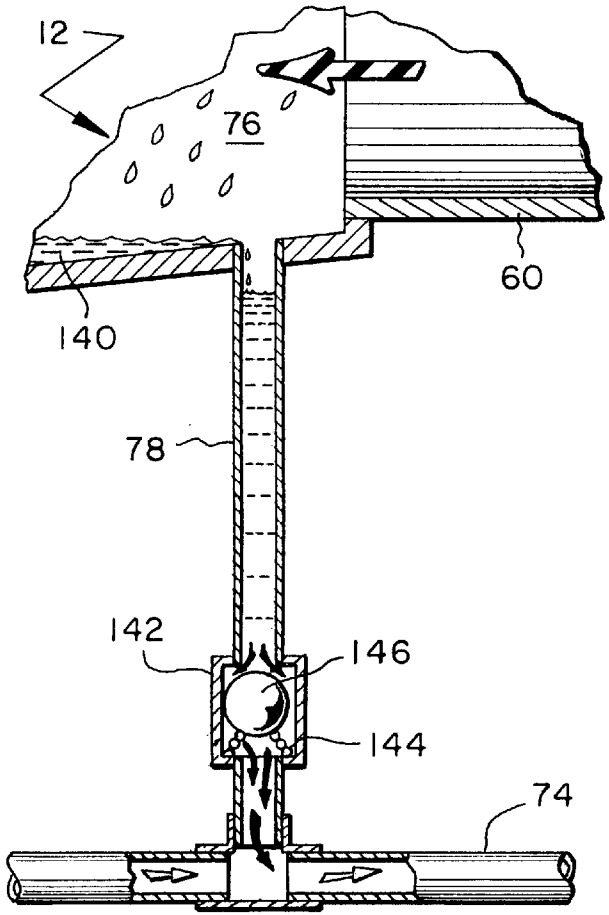

Referring additionally now to FIGS. 6 and 7, the apparatus by which accumulated oil is returned from suction housing 76 of compressor 12 to oil supply tank 62 will be described. In that regard and as earlier mentioned, lubricant entrained in the suction gas travelling to suction housing 76 through piping 60 will tend to be disentrained within the suction housing due to impact with the compressor structure in that relatively very low pressure location and will accumulate there. In many existing and prior systems, the return of such disentrained oil from the suction housing back to the oil supply tank was accomplished by an eductor which relied upon the existence of a pressure differential within the chiller which, in the context of new refrigerants used in chiller systems, may be unavailable under some system operating conditions. While intermittent operation of an eductor for this particular purpose is, for the most part, sufficient, more reliable and simple apparatus for returning lubricant from the suction housing of the compressor to the chiller's oil supply tank, whenever oil in a sufficient quantity accumulates in the suction housing and whatever chiller operating conditions might be, would be advantageous. In the chiller of the present invention, apparatus is provided to ensure the delivery of accumulated lubricant from suction housing 76 back to oil supply tank 62 under all chiller operating conditions and whenever a predetermined amount of oil accumulates in the suction housing.

Referring first to FIG. 6, when sufficient lubricant pools in suction housing 76 at location 140 therein it overflows into conduit 78 which defines a holding volume for lubricant that flows thereinto from suction housing 76. Disposed in conduit 78 is a check valve 142 which is biased by a predetermined force, in this case through a spring 144 and any pressure that may be found in line 74, to remain closed until a predetermined amount of lubricant has overflowed out of housing 76 into conduit 78. At such time as an amount of lubricant has overflowed into conduit 78 which is sufficient to displace element 146 of valve 142 against the biasing force holding it shut so as to permit flow therearound, lubricant flows out of conduit 78, through and past check valve 142 and back to the oil supply tank through line 74. FIG. 6 illustrates the circumstance where sufficient lubricant has overflowed into conduit 78 to displace element 146 and where lubricant flow through check valve 142 into line 74 is occurring. FIG. 7 illustrates the circumstance where conduit 78 has emptied of lubricant and is not yet sufficiently refilled by overflow from location 140 to overcome the biasing force on element 146 to permit flow through valve 142.

In the case of FIGS. 6 and 7, check valve 142 is illustrated to be in flow communication with line 74 which, once again, connects to the interior of oil supply tank 62. As will be recalled, lubricant also flows through piping 74 in its return from the location of its use in lubricating bearings 48 and 50 back to the oil supply tank. As will be apparent, conduit 78 and check valve 142 could be placed in direct flow communication with the interior of supply tank 62 rather than being connected thereto via piping 74 as illustrated. The force with which element 146 is biased and the amount of lubricant that must fill conduit 78 to overcome such force is, of course, predetermined to ensure that oil will continuously be returned to supply tank 62 when sufficient oil has accumulated within conduit 78. It is to be noted that because a slight differential pressure will typically exist across check valve 142 which acts to keep element 146 seated and conduit 78 closed to flow, it may be possible to eliminate the use of the biasing mechanism that acts on element 146 (spring 144 in this case).

Figure 8:
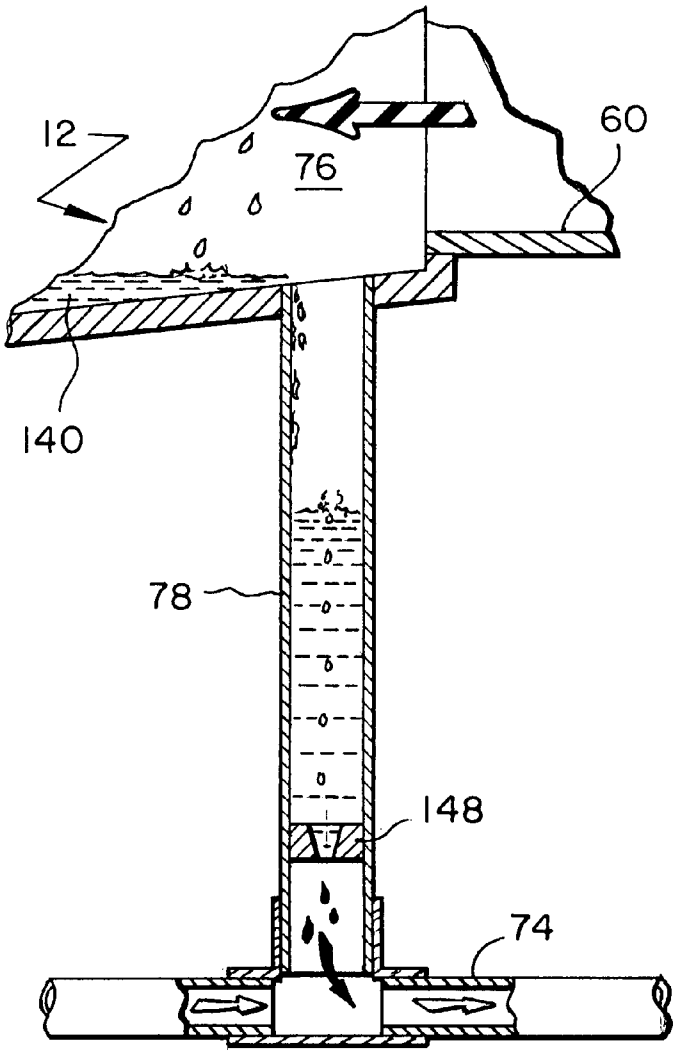
FIG. 8 illustrates an alternative embodiment to the oil return arrangement illustrated in FIGS. 6 and 7.

Referring now to FIG. 8, an alternative to the oil return apparatus of FIGS. 6 and 7 will be described. In the embodiment of FIG. 8, rather than there being a check valve arrangement disposed in conduit 78, an orifice 148 is disposed within conduit 78 through which oil flows for return to supply tank 22 whenever the amount oil is in conduit 78 is sufficient to overcome any pressure existing downstream thereof within pipe 74. As is the case with the embodiment of FIGS. 6 and 7, conduit 78 is sized such that whenever a predetermined amount of oil is contained therein, a continuous dribble of oil through orifice 148 is ensured under all system operating conditions. The embodiment of FIG. 8 does pose a somewhat more difficult design problem to the extent of determining the appropriate size for orifice 148 but is mechanically more simple and, in that regard, reliable than the embodiment of FIGS. 6 and 7. Both the embodiment of FIGS. 6 and 7 and the embodiment of FIG. 8 advantageously eliminate the need for and expense of an eductor to return oil from the suction housing and more reliably return oil from that location because, unlike an eductor, their operation does not depend upon the existence of a system pressure differential and, instead, relies on the weight of accumulated oil as the impetus to oil return.

Figure 10:
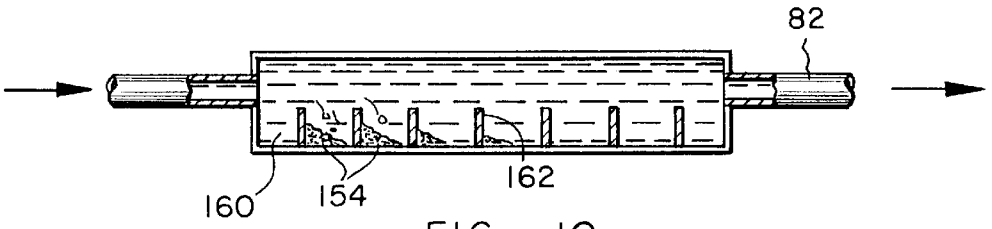
FIGS. 9, 10 and 11 illustrate apparatus for trapping debris which is disposed in the line by which the oil-rich liquid that collects in the bottom of the chiller system's evaporator is returned to the chiller's oil supply tank.
Figure 9:
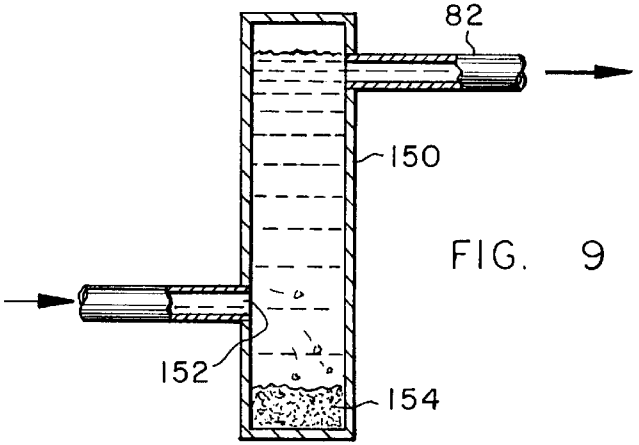
Figure 11:
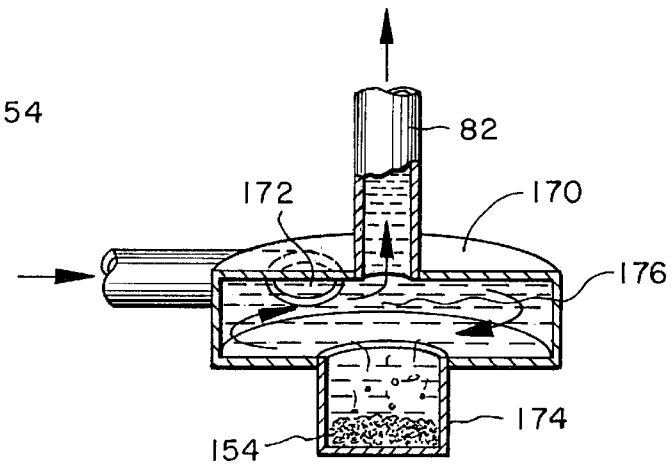

Referring additionally now to FIGS. 9, 10 and 11 and as was earlier mentioned, a filter 88 can be disposed, in the preferred embodiment of FIGS. 1 and 2, in line 82 by which the oil-rich fluid that settles in the bottom of evaporator 16 is returned to oil supply tank 62. FIGS. 9, 10 and 11 illustrate apparatus, other than a replaceable filter, by which particulate and debris in that mixture can be separated and trapped in structures permanently built into chiller 10. In each case, the apparatus defines an expanded volume and operates to slow the flow of the mixture flowing thereinto. This permits debris that would not normally be held in suspension in the mixture to settle through the mixture and be trapped in such apparatus.

Referring first to FIG. 9, a stand pipe-like arrangement is illustrated. Flow is out of the bottom of evaporator 16 and into a lower portion of separator 150 through inlet 152 where the mixture's flow rate slows. Any particulate therein, being relatively heavy, will tend to settle in trap portion 154 of the separator where it will be retained. The fluid flowing out of separator 150 back to the oil supply tank through line 82 will be relatively free of particulate and debris. Like the following embodiments of FIGS. 10 and 11, separator 150 needs no maintenance or replacement for the reason that sediment trap 154 is sized to contain essentially all of the larger particulate/debris that can be expected to normally be carried out of evaporator 16 and to the oil supply tank.

The apparatus of FIG. 10 involves a progressive sediment trapping arrangement, similar to a sluice pipe, where sediment falls out of the fluid flowing through housing 160 at a slowed rate as such flow progresses downstream therethrough. Accumulated sediment is shielded from flow and is maintained in housing 160 by a series of progressive barrier walls 162 as is illustrated.

Referring now to FIG. 11, centrifugal sediment separation structure is illustrated. In the separator structure 170 of FIG. 11, fluid flowing from condenser 16 enters structure 170 tangentially through a side wall inlet 172. Structure 170 is cylindrically shaped so that the fluid entering it through inlet 172 is caused to swirl. Particulate within the fluid eventually makes its way into the relatively quiescent central portion of structure 170 where settles downward into particulate trap 174. Relatively particulate free lubricant-rich liquid will exit the central portion of structure 170 through pipe 82 and will be delivered therethrough to the chiller's oil supply tank.

It is to be noted that the apparatus of FIGS. 9, 10 and 11 is designed to trap sediment that will most often be carried thereinto during the initial hours of operation of the chiller. Such sediment will consist of copper flakes from the finned tubes found within the condenser and evaporator, weld slag, shop grit and the like that is retained inside the chiller immediately subsequent to its manufacture despite the best efforts to ensure that the interior of the chiller is clean prior to closing it and introducing the refrigerant charge. Such sediment is typically washed into and settles to the bottom of the evaporator by the initial flow of refrigerant through the chiller's refrigeration circuit and is not continuously created. Most of the sediment which does continue circulate with the chiller system refrigerant and/or its lubricant will be smaller, lighter, held in suspension and will eventually be caught by the filter 67 shown in FIGS. 1 and 2 associated with manifold 66 that is mounted on the chiller's oil supply tank. The main purpose of the apparatus of FIGS. 9, 10 and 11, once again, is to immediately and permanently trap the heavier particulate/debris that remains in the chiller system immediately subsequent to its manufacture. As will be apparent, however, access to the interior of such structures to remove such debris therefrom could easily be accomplished and falls within the scope of the present invention.

Referring now to FIGS. 1, 2, 4 and 12, an alternative arrangement for returning oil used to lubricate bearings 48 and 50 to oil supply tank 62 which eliminates a potential problem caused by the venting through line 80 of the oil supply tank to evaporator 16 will be described. It is to be noted that the embodiment of FIG. 12 may, in fact, ultimately prove to be the preferred embodiment with respect to the return of oil from the bearing locations in chiller 10 to the oil supply tank.

As is mentioned above, oil supply tank 62 is vented, in the embodiment of FIGS. 1 and 2, through line 80 to evaporator 16. Because it contains a quantity of refrigerant which is entrained within it, the oil 99 in supply tank 62 will foam vigorously under certain severe chiller start-up conditions. Such refrigerant may reside within the oil in the oil supply tank in liquid form or may reside there in the form of gas bubbles entrained therein. This refrigerant is present in the supply tank as a result of the return of oil-rich liquid from the bottom of the evaporator through line 82 to the oil supply tank (the portion of this liquid which is other than oil will be liquid refrigerant) and because liquid refrigerant which has flashed to gas within motor barrel 54 in the motor cooling process will make its way through shaft seals into the location of oil-lubricated bearings 42 and 48 from where it will be carried back to the oil supply tank.

Under certain relatively severe operating conditions, the pressure in evaporator 16 will drop immediately and precipitously as the chiller starts up. Because, in the preferred embodiment, tank 62 is vented to evaporator 16, a drop in pressure in evaporator 16 causes a corresponding pressure drop in the oil tank which, in turn, causes liquid refrigerant entrained in the oil in the oil supply tank 62 to flash to gas and refrigerant bubbles entrained therein to be liberated. This, in turn, causes the oil in supply tank 62 to foam vigorously. Because the pressure in evaporator 16 under such circumstances will be lower than that which will be found in oil supply tank 62, the foam formed in the supply tank, which in large part will consist of oil, is drawn out of the oil supply tank and into the evaporator. That, in turn, can deplete the supply of oil in the oil supply tank and result in the shutdown of the chiller on a low oil diagnostic.

Figure 12:
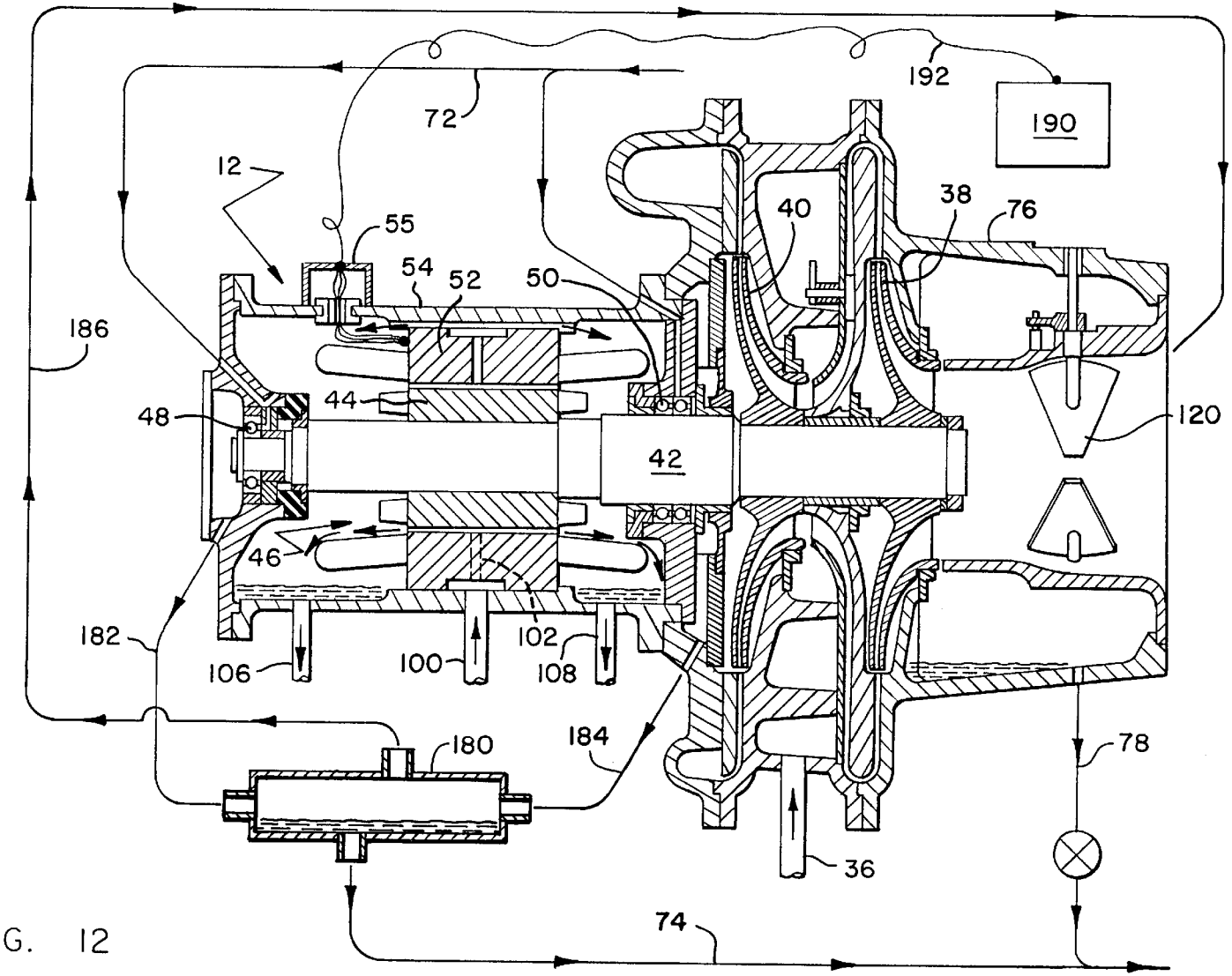
FIG. 12 is identical to FIG. 3 other than in its illustration an alternative embodiment of the portion of the chiller of the present invention by which lubricant is returned from the compressor portion of the chiller to the chiller's oil supply tank.

In the embodiment of FIG. 12, vent line 80 from the oil supply tank to evaporator 16 is dispensed with and a remote manifold 180 is employed by which to return lubricant from bearings 48 and 50 through oil return line 74 to the oil supply tank. Manifold 180 is a simple cylinder into which oil, in which refrigerant may be entrained, is communicated through lines 182 and 184 from the compressor bearing locations. It will be recalled that in the embodiment of FIGS. 1 and 2, oil return lines 182 and 184 feed line 74 directly. In the case of this alternative embodiment of FIG. 12, manifold 180 is interposed therebetween.

Because manifold 180 defines an expanded volume, it provides a location in which the refrigerant gas and oil flowing thereinto from lines 182 and 184 separates with the oil settling to the bottom thereof and the gas collecting in its upper region. Such gas is vented out of manifold 180 through line 186 back to a convenient low pressure location such as suction housing 76. The separated lubricant, from which refrigerant has been removed, then flows out of manifold 180 into line 74 for return to oil supply tank 62.

Even with the use of manifold 180, foaming will occur in oil supply tank 62 when the chiller starts under severe start conditions for the reason that the oil supply tank is, even in the alternative embodiment of FIG. 12, in flow communication through manifold 180 to a low pressure location within the chiller. However, because supply tank 62 is not vented directly to the evaporator (as a result of the use of remote manifold 180 for the venting purpose) and because manifold 180 acts to reduce the amount of refrigerant delivered into the oil supply tank, the amount of foam created in oil supply tank under severe chiller start-up conditions will be less and it will be retained therein. As such, the loss of lubricant from the oil supply tank due to such foaming is prevented. As will be appreciated, manifold 180 is of simple construction and includes no moving parts. While in the embodiment of FIG. 12, manifold 180 is shown vented to suction housing 76, it too could be vented to the evaporator yet achieve the same results due to its remote location from the oil supply tank.

Referring back now to FIGS. 1 and 2, a still further aspect of the present invention will be discussed, that being the employment of a variable speed drive/controller 190 by which variable speed operation of the compressor portion 12 of the chiller is accomplished. Controller 190 is a physically large, high voltage controller which, in the context of its regulating the power supply through power supply line 192 to compressor drive motor 46 for variable speed compressor operation, generates a large quantity of heat. In order to permit controller 190 to function reliably, it must be proactively cooled.

Presently, controller 190 is designed by the controller manufacturer to be cooled by air as are most large chiller controllers and drives. Because the chiller of the present invention has solved the problem of pumping saturated liquid refrigerant without causing significant flashing thereof, it has prospectively been determined that controller 190 can much more efficiently, effectively and reliably be cooled by pumping liquid refrigerant to it for purposes of cooling its heat-generating components. Such cooling is prospectively planned to be accomplished by diverting a portion of the liquid refrigerant that is pumped through line 100 to motor barrel 54 for motor cooling purposes through a branch line 192 and into the interior of the controller housing. It will there be delivered into heat exchange contact with power components that require cooling.

Refrigerant delivered to controller 190 for cooling purposes will then be drained through line 194 back to the chiller condenser in essentially the same fashion that refrigerant is returned after having been used for compressor drive motor cooling purposes. As will be appreciated, operation of this controller cooling arrangement is predicated upon and follows the motor cooling precepts of sourcing the refrigerant used for the cooling purpose from the relatively high pressure condenser, pumping it to the location of its cooling use and then returning such refrigerant back to the relatively high pressure condenser all of which, in turn, is predicated on the ability to pump saturated liquid refrigerant without causing significant flashing thereof.

While the present invention has been taught in terms of a preferred embodiment, with several alternative embodiments and modifications thereto having been described, it will be appreciated that it is not limited in scope to such preferred embodiment but encompasses other embodiments and modifications that will be apparent to those skilled in the art.

What is claimed is:

1. A liquid chiller comprising:

a compressor;

a motor for driving said compressor;

a housing, said motor being disposed in said housing;

an evaporator, said evaporator being connected for refrigerant flow to said compressor;

an oil supply tank, said oil supply tank being physically disposed below said compressor;

pump apparatus, said pump apparatus delivering oil from said oil supply tank to said compressor for lubrication purposes and liquid refrigerant to said motor for motor cooling purposes; and a condenser, said condenser receiving refrigerant from said compressor, supplying refrigerant to said evaporator, being the source for liquid refrigerant that is delivered by said pump apparatus to said motor for cooling purposes and being the location to which at least a major portion of the refrigerant used in the cooling of said motor is returned subsequent to cooling said motor.

2. The liquid chiller according to claim 1 wherein said pump apparatus includes a first pumping mechanism for pumping liquid refrigerant and a second pumping mechanism for pumping oil, said oil supply tank and both said first pumping mechanism and said second pumping mechanism being physically disposed below said condenser.

3. The liquid chiller according to claim 2 further comprising an economizer, said economizer receiving refrigerant from said condenser at a first pressure, said economizer delivering refrigerant gas to said compressor and liquid refrigerant to said evaporator at a pressure lower than said first pressure.

4. The liquid chiller according to claim 3 wherein said first and said second pumping mechanisms are driven by a single motor and are both physically disposed below said condenser.

5. The liquid chiller according to claim 3 wherein said compressor defines a location where lubricant which is disentrained from the suction gas that is delivered from said evaporator to said compressor settles and further comprising a holding volume into which said disentrained lubricant flows from said compressor location; and, apparatus for controllably permitting the flow of oil from said holding volume to said oil supply tank.

6. The liquid chiller according to claim 5 wherein said apparatus for controllably permitting the flow of oil from said holding volume to said oil supply tank is a check valve, said check valve permitting the flow of oil from said holding volume to said oil supply tank when said holding volume comes to contain an amount of oil sufficient to overcome the biasing force by which said check valve is held shut.

7. The liquid chiller according to claim 3 further comprising a manifold, said manifold being in flow communication with said compressor and with said oil supply tank, said manifold receiving oil subsequent to its use in lubricating said compressor and defining a volume in which oil and refrigerant entrained therein separate, oil from which refrigerant has been separated in said manifold being returned therefrom to said oil supply tank and refrigerant which has been separated from oil in said manifold being vented therefrom to a location in said chiller which is at the same or a lower pressure.

8. The liquid chiller according to claim 3 further comprising an oil cooling heat exchanger, said oil cooling heat exchanger being disposed in said economizer and being cooled by liquid refrigerant contained therein, said oil cooling heat exchanger receiving and cooling oil pumped to it from said oil supply tank by said second pumping mechanism prior to the delivery thereof to said compressor for lubrication purposes.

9. The liquid chiller according to claim 3 wherein said motor is a variable speed motor and further comprising a controller, said controller controlling the speed of said motor, said first pumping mechanism pumping liquid refrigerant from said condenser to said controller for purposes of cooling heat generating components therein, refrigerant delivered to said controller for said cooling purpose being returned to said condenser therefrom.

10. The liquid chiller according to claim 2 further comprising a motor lead housing disposed on said compressor drive motor housing, said motor lead housing being the location at which electrical power is connected to said chiller for purposes of driving said motor, said motor housing and said motor lead housing being maintained at a temperature which is sufficient to prevent the formation of condensation in said lead housing whenever said chiller is in operation as a result of the flow communication between said motor housing and said condenser.

11. The liquid chiller according to claim 2 wherein a mixture of oil and liquid refrigerant settles in the lower portion of said evaporator and further comprising means for delivering said mixture from said evaporator to said oil supply tank; and, apparatus for slowing the speed of said mixture subsequent to its exit from said evaporator but prior to its delivery to said oil supply tank, said apparatus permitting debris to settle out of said slowed mixture and be trapped therein so as to prevent the delivery of said debris into said oil supply tank.

12. The liquid chiller according to claim 11 wherein said apparatus comprises a sluice pipe arrangement which includes a series of walls progressively disposed in the direction of flow of said mixture.

13. The liquid chiller according to claim 2 wherein said first and said second pumping mechanisms are driven by a single motor.

14. The liquid chiller according to claim 13 further comprising an economizer, said economizer receiving refrigerant from said condenser at a first pressure, said economizer delivering refrigerant gas to said compressor and liquid refrigerant to said evaporator at a pressure lower than said first pressure.

15. The liquid chiller according to claim 13 wherein said compressor defines a location where lubricant which is disentrained from the suction gas that is delivered from said evaporator to said compressor settles and further comprising a holding volume into which said disentrained lubricant flows from said compressor location; and, the apparatus for controllably permitting the flow of oil from said holding volume to said oil supply tank.

16. The liquid chiller according to claim 15 wherein said apparatus for controllably permitting the flow of oil from said holding volume to said oil supply tank is a check valve, said check valve permitting the flow of oil from said holding volume to said oil supply tank when said holding volume comes to contain an amount of oil sufficient to overcome the biasing force by which said check valve is held shut.

17. The liquid chiller according to claim 13 further comprising a manifold, said manifold being in flow communication with said compressor and with said oil supply tank, said manifold receiving oil subsequent to its use in lubricating said compressor and defining a volume in which oil and refrigerant entrained therein separate, oil from which refrigerant has been separated in said manifold being returned therefrom to said oil supply tank and refrigerant which has been separated from oil in said manifold being vented therefrom to a location in said chiller which is at the same or a lower pressure.

18. The liquid chiller according to claim 13 wherein said motor is a variable speed motor and further comprising a controller, said controller controlling the speed of said motor, said first pumping mechanism pumping liquid refrigerant from said condenser to said controller for purposes of cooling heat generating components therein, refrigerant delivered to said controller being returned to said condenser therefrom.

19. The liquid chiller according to claim 13 wherein a mixture of oil and liquid refrigerant settles in the lower portion of said evaporator and further comprising means for delivering said mixture from said evaporator to said oil supply tank; and, apparatus for slowing the speed of said mixture subsequent to its exit from said evaporator but prior to its delivery to said oil supply tank, said apparatus permitting debris to settle out of said mixture and be trapped therein so as to prevent the delivery of said debris into said oil supply tank.

20. The liquid chiller according to claim 2 wherein said compressor defines a location where lubricant which is disentrained from the suction gas that is delivered from said evaporator to said compressor settles and further comprising a holding volume into which said disentrained lubricant flows from said compressor location; and, apparatus for controllably permitting the flow of oil from said holding volume to said oil supply tank.

21. The liquid chiller according to claim 20 further comprising an economizer, said economizer receiving refrigerant from said condenser at a first pressure, said economizer delivering refrigerant gas to said compressor and liquid refrigerant to said evaporator at a pressure lower than said first pressure.

22. The liquid chiller according to claim 20 wherein said first and said second pumping mechanisms are driven by a single motor.

23. The liquid chiller according to claim 20 wherein said apparatus for controllably permitting the flow of oil from said holding volume to said oil supply tank is a check valve, said check valve permitting the flow of oil from said holding volume to said oil supply tank when said holding volume comes to contain an amount of oil sufficient to overcome the biasing force by which said check valve is held shut.

24. The liquid chiller according to claim 20 further comprising a manifold, said manifold being in flow communication with said compressor and with said oil supply tank, said manifold receiving oil subsequent to its use in lubricating said compressor and defining a volume in which oil and refrigerant entrained therein separate, oil from which refrigerant has been separated in said manifold being returned therefrom to said oil supply tank and refrigerant which has been separated from oil in said manifold being vented therefrom to a location in said chiller which is at the same or a lower pressure.

25. The liquid chiller according to claim 20 wherein said motor is a variable speed motor and further comprising a controller, said controller controlling the speed of said motor, said first pumping mechanism pumping liquid refrigerant from said condenser to said controller for purposes of cooling heat generating components therein, refrigerant delivered to said controller being returned to said condenser therefrom.

26. The liquid chiller according to claim 20 wherein a mixture of oil and liquid refrigerant settles in the lower portion of said evaporator and further comprising means for delivering said mixture from said evaporator to said oil supply tank; and, apparatus for slowing the speed of said mixture subsequent to its exit from said evaporator but prior to its delivery to said oil supply tank, said apparatus permitting debris to settle out of said mixture and be trapped therein so as to prevent the delivery of said debris into said oil supply tank.

27. The liquid chiller according to claim 20 wherein said apparatus for controllably permitting the flow of oil from said holding volume to said oil supply tank comprises a metering orifice.

28. The liquid chiller according to claim 2 wherein said compressor and said oil supply tank are connected by a conduit and further comprising a vent and a check valve, said vent venting said oil supply tank to said evaporator and said check valve preventing flow from said evaporator through said vent, through said oil supply tank and through said conduit to said compressor, said check valve being disposed in said conduit and permitting the flow of oil which is disentrained from the suction gas that is delivered from said evaporator to said compressor to said oil supply tank when said conduit comes to contain an amount of oil sufficient to overcome the biasing force by which said check valve is held shut.

29. The liquid chiller according to claim 28 wherein said first and said second pumping mechanisms are driven by a single motor.

30. The liquid chiller according to claim 28 wherein said compressor defines a location where lubricant which is disentrained from the suction gas that is delivered from said evaporator to said compressor settles and wherein said conduit defines a holding volume upstream of said check valve into which said disentrained lubricant flows from said compressor location.

31. The liquid chiller according to claim 28 further comprising an economizer, said economizer receiving refrigerant from said condenser at a first pressure, said economizer delivering refrigerant gas to said compressor and liquid refrigerant to said evaporator at a pressure lower than said first pressure.

32. The liquid chiller according to claim 28 wherein said motor is a variable speed motor and further comprising a controller, said controller controlling the speed of said motor, said first pumping mechanism pumping liquid refrigerant from said condenser to said controller for purposes of cooling heat generating components therein, refrigerant delivered to said controller being returned to said condenser therefrom.

33. The liquid chiller according to claim 28 wherein a mixture of oil and liquid refrigerant settles in the lower portion of said evaporator and further comprising means for delivering said mixture from said evaporator to said oil supply tank; and, apparatus for slowing the speed of said mixture subsequent to its exit from said evaporator but prior to its delivery to said oil supply tank, said apparatus permitting debris to settle out of said mixture and be trapped therein so as to prevent the delivery of said debris into said oil supply tank.

34. The liquid chiller according to claim 2 further comprising a manifold, said manifold being in flow communication with said compressor and with said oil supply tank, said manifold receiving oil subsequent to its use in lubricating said compressor and defining a volume in which oil and refrigerant entrained therein separate, oil from which refrigerant has been separated in said manifold being returned therefrom to said oil supply tank and refrigerant which has been separated from oil in said manifold being vented therefrom to a location in said chiller which is at the same or a lower pressure.

35. The liquid chiller according to claim 34 wherein said oil supply tank is unvented other than through said manifold.

36. The liquid chiller according to claim 34 further comprising an economizer, said economizer, said economizer receiving refrigerant from said condenser at a first pressure, said economizer delivering refrigerant gas to said compressor and liquid refrigerant to said evaporator at a pressure lower than said first pressure.

37. The liquid chiller according to claim 34 wherein said first and said second pumping mechanisms are driven by a single motor.

38. The liquid chiller according to claim 34 wherein said compressor defines a location where lubricant which is disentrained from the suction gas that is delivered from said evaporator to said compressor settles and further comprising a holding volume into which said disentrained lubricant flows from said compressor location; and, apparatus for controllably permitting the flow of oil from said holding volume to said oil supply tank.

39. The liquid chiller according to claim 34 wherein said motor is a variable speed motor and further comprising a controller, said controller controlling the speed of said motor, said first pumping mechanism pumping liquid refrigerant from said condenser to said controller for purposes of cooling heat generating components therein, refrigerant delivered to said controller being returned to said condenser therefrom.

40. The liquid chiller according to claim 34 wherein a mixture of oil and liquid refrigerant settles in the lower portion for said evaporator and further comprising means for delivering said mixture from said evaporator to said oil supply tank; and, apparatus for slowing the speed of said mixture subsequent to its exit from said evaporator but prior to its delivery to said oil supply tank, said apparatus permitting debris to settle out of said mixture and be trapped therein so as to prevent the delivery of said debris into said oil supply tank.

41. The liquid chiller according to claim 2 wherein said motor is a variable speed motor and further comprising a controller, said controller controlling the speed of said motor, said first pumping mechanism pumping liquid refrigerant from said condenser to said controller for purposes of cooling heat generating components therein, refrigerant delivered to said controller being returned to said condenser therefrom.

42. The liquid chiller according to claim 41 wherein said first and said second pumping mechanisms are driven by a single motor.

43. The liquid chiller according to claim 41 wherein said compressor defines a location where lubricant which is disentrained from the suction gas that is delivered from said evaporator to said compressor settles and further comprising a holding volume into which said disentrained lubricant flows from said compressor location; and, apparatus for controllably permitting the flow of oil from said holding volume to said oil supply tank.

44. The liquid chiller according to claim 41 further comprising a manifold, said manifold being in flow communication with said compressor and with said oil supply tank, said manifold receiving oil subsequent to its use in lubricating said compressor and defining a volume in which oil and refrigerant entrained therein separate, oil from which refrigerant has been separated in said manifold being returned therefrom to said oil supply tank and refrigerant which has been separated from oil in said manifold being vented therefrom to a location in said chiller which is at the same or a lower pressure.

45. The liquid chiller according to claim 41 further comprising an economizer, said economizer receiving refrigerant from said condenser at a first pressure, said economizer delivering refrigerant gas to said compressor and liquid refrigerant to said evaporator at a pressure lower than said first pressure.

46. The liquid chiller according to claim 2 further comprising a motor lead housing, said motor lead housing being the location at which power is connected to said chiller for purposes of driving said motor, said motor housing and said lead housing being maintained at a temperature which is sufficient to prevent the formation of condensation in said lead housing whenever said chiller is in operation as a result of the flow communication between said drive motor housing and said condenser.

47. The liquid chiller according to claim 2 wherein a mixture of oil and liquid refrigerant settles in the lower portion of said evaporator and further comprising means for delivering said mixture from said evaporator to said oil supply tank; and, apparatus for slowing the speed of said mixture subsequent to its exit from said evaporator but prior to its delivery to said oil supply tank, said apparatus permitting debris to settle out of said mixture and be trapped therein so as to prevent the delivery of said debris into said oil supply tank.

48. The liquid chiller according to claim 47 wherein said apparatus comprises a sluice pipe arrangement which includes a series of walls progressively disposed in the direction of flow of said mixture.

49. The liquid chiller according to claim 2 wherein said chiller is a centrifugal chiller and further comprising a shaft; at least one bearing; and, at least one impeller, said shaft being mounted for rotation in said at least one bearing and the rotor of said motor being mounted on said shaft for rotation therewith, said second pumping mechanism pumping oil to said at least one bearing.

50. The liquid chiller according to claim 49 wherein said compressor defines a location where lubricant which is disentrained from the suction gas that is delivered from said compressor to said evaporator settles; and, apparatus for controllably permitting the flow of oil from said holding volume to said oil supply tank.

51. The liquid chiller according to claim 50 wherein said compressor has a first and a second impeller, said first and said second impellers being mounted for rotation on said shaft, said first impeller increasing the pressure of refrigerant gas delivered to it from said evaporator to a first pressure and said second impeller increasing the pressure of refrigerant gas received from said first impeller to a second and higher pressure and further comprising an economizer, said economizer receiving refrigerant from said condenser and said economizer delivering refrigerant gas to said compressor at a pressure intermediate said first and said second pressure so as to increase the pressure of refrigerant gas being delivered to said second impeller from said first impeller and said economizer delivering liquid refrigerant to said evaporator.

52. The liquid chiller according to claim 50 wherein said motor is a variable speed motor and further comprising a controller, said controller controlling the speed of said motor, said first pumping mechanism pumping liquid refrigerant from said condenser to said controller for purposes of cooling heat generating components therein, refrigerant delivered to said controller for said cooling purpose being returned to said condenser therefrom.

53. The liquid chiller according to claim 50 further comprising a manifold, said manifold being in flow communication with said compressor and with said oil supply tank, said manifold receiving oil subsequent to its use in lubricating said at least one bearing and defining a volume in which oil and refrigerant entrained therein separate, oil from which refrigerant has been separated in said manifold being returned therefrom to said oil supply tank and refrigerant which has been separated from oil in said manifold being vented therefrom to a location in said chiller which is at the same or a lower pressure.

54. The liquid chiller according to claim 50 further comprising a holding volume into which said disentrained lubricant flows from said compressor location and wherein said apparatus for controllably permitting the flow of oil from said holding volume to said oil supply tank is a check valve.

55. A liquid chiller comprising:

an evaporator;

a compressor, said compressor receiving refrigerant gas from said evaporator;

a motor for driving said compressor, said motor being a variable speed motor;

a housing, said motor being disposed in said housing;

a controller, said controller controlling the speed of said motor;

an oil supply tank;

pump apparatus, said pump apparatus delivering oil from said oil supply tank to said compressor for lubrication purposes and delivering liquid refrigerant both to said motor and to said controller for purposes of cooling said motor and said controller; and a condenser, said condenser receiving refrigerant from said compressor, supplying refrigerant to said evaporator, being the source for liquid refrigerant that is delivered by said pump apparatus to said motor and to said controller for cooling purposes and being the location to which refrigerant used in the cooling of said motor and said controller is returned subsequent to cooling said motor and said controller.

56. The liquid chiller according to claim 55 wherein said pump apparatus includes a first pumping mechanism for pumping liquid refrigerant to said motor and said controller and a second pumping mechanism for pumping oil to said compressor.

57. The liquid chiller according to claim 56 wherein refrigerant pumped to said motor and to said controller is returned to said condenser.

58. The liquid chiller according to claim 57 wherein said compressor defines a location where lubricant which is disentrained from the suction gas that is delivered from said evaporator to said compressor settles and further comprising apparatus for controllably returning oil from said location to said oil supply tank in accordance with the amount of oil which exists upstream of said oil return control apparatus.

59. The liquid chiller according to claim 58 further comprising a holding volume defined between said oil return control apparatus and said location in said compressor where lubricant which is disentrained from the suction gas that is delivered from said evaporator to said compressor settles and wherein said oil return control apparatus comprises a check valve, said check valve being disposed between said holding volume and said oil supply tank.

60. The liquid chiller according to claim 57 further comprising an economizer, said economizer receiving refrigerant from said condenser at a first pressure and delivering refrigerant gas to said compressor and liquid refrigerant to said evaporator at a pressure lower than said first pressure.

61. The liquid chiller according to claim 57 wherein said first and said second pumping mechanisms are physically disposed below said condenser and wherein said first pumping mechanism and said second pumping mechanism are commonly driven by a single motor.

62. The liquid chiller according to claim 57 further comprising a manifold, said manifold being in flow communication with said compressor and with said oil supply tank, said manifold receiving oil subsequent to its use in lubricating said compressor and defining a volume in which oil and refrigerant entrained therein separate, oil from which refrigerant has been separated in said manifold being returned therefrom to said oil supply tank and refrigerant which has been separated from oil in said manifold being vented therefrom to a location in said chiller which is at the same or a lower pressure.

63. A method for providing compressor bearing lubrication and compressor drive motor cooling in a centrifugal liquid chiller where the chiller includes a compressor, a compressor drive motor, a condenser, an evaporator and an oil supply tank, comprising the steps of:

pumping liquid refrigerant from said condenser to said compressor drive motor for purposes of cooling said motor;

returning refrigerant pumped to said drive motor in said pumping step to said condenser;

pumping oil from said oil supply tank to said compressor for bearing lubrication purposes;

returning oil pumped to said compressor for bearing lubrication purposes to said oil supply tank;

controllably returning oil which has become disentrained from refrigerant delivered from said evaporator to said compressor and which has settled in a location in said compressor to said oil supply tank.

64. The method according to claim 63 comprising the further steps of: controlling the speed of said drive motor; pumping liquid refrigerant from said condenser to the apparatus by which the speed of said motor is controlled so as to cool said speed control apparatus; and, returning refrigerant pumped to said speed control apparatus to said condenser.

65. The method according to claim 63 wherein said step of controllably returning lubricant from said compressor to said oil supply tank includes the steps of: separating refrigerant entrained in the oil being returned from said compressor to said oil supply tank prior to the delivery of the oil to said oil supply tank; and, returning the refrigerant separated from the oil being returned to said oil supply tank to the chiller's refrigeration circuit.

66. The method according to claim 63 comprising the further step of driving the pumping mechanisms by which oil is pumped in said oil pumping step and by which liquid refrigerant is pumped in said refrigerant pumping steps with a single motor.

67. The method according to claim 63 wherein said step of controllably returning oil from said compressor to said oil supply tank comprises the step of continuously metering oil from said compressor to said oil supply tank through an orifice.

68. The method according to claim 63 comprising the further steps of: causing the flashing of a portion of the liquid refrigerant that is delivered from said condenser to said evaporator to gas in an economizer; and, delivering said flash gas to said compressor.

69. The method according to claim 68 comprising the further step of cooling oil pumped in said oil pumping step within said economizer.

70. The method according to claim 63 comprising the further steps of: returning the mixture of oil and liquid refrigerant that settles in the lower portion of said evaporator of said chiller to said oil supply tank; slowing the speed of said mixture, subsequent to its exit from said evaporator but prior to its delivery to said oil supply tank, so as to permit debris contained therein to settle downwardly therethrough; and, trapping debris that settles downwardly through said mixture so as to prevent its delivery to said oil supply tank.

71. The method according to claim 63 wherein said step of returning oil from said compressor to said oil supply tank includes the steps of: defining a holding volume; and, delivering oil from said location in said compressor where oil settles to said holding volume prior to the return thereof to said oil supply tank.

72. The method according to claim 71 wherein said step of controllably returning oil from said compressor to said oil supply tank includes the step of placing said holding volume in flow communication with said oil supply tank when said holding volume comes to contain a predetermined amount of oil.

* * * * *